United States Patent [19]

Eguchi et al.

[11] Patent Number: 4,532,874

[45] Date of Patent: Aug. 6, 1985

[54] HEM STITCHING PRESSER FOOT FOR A ZIGZAG SEWING MACHINE

[75] Inventors: Yasukata Eguchi; Mikio Inamori, both of Tokyo, Japan

[73] Assignee: Janome Sewing Machine Co. Ltd., Tokyo, Japan

[21] Appl. No.: 567,786

[22] Filed: Jan. 3, 1984

[30] Foreign Application Priority Data

Jan. 6, 1983 [JP] Japan ..... 58-89[U]

[51] Int. Cl.[3] ..... D05B 29/12; D05B 35/02

[52] U.S. Cl. ..... 112/235; 112/151; 112/153; 112/302

[58] Field of Search ..... 112/141, 151, 157, 235, 112/302, 158 R, 153, 150

[56] References Cited

U.S. PATENT DOCUMENTS 1,535,356 4/1925 Thomas ..... 112/235
3,070,052 12/1962 Freeman ..... 112/235
4,459,928 7/1984 Eguchi ..... 112/235 X

*Primary Examiner*—Werner H. Schroeder
*Assistant Examiner*—Andrew M. Falik
*Attorney, Agent, or Firm*—Michael J. Striker

[57] ABSTRACT

A hand stitching presser foot, for a zigzag sewing machine having a fabric feed direction and a presser foot holder, for forming a hem on a fabric, the presser foot consisting of a fabric presser member pivotally mounted to the presser foot holder and having one end, an elastic fabric presser portion and a cutout having an open edge extending in the fabric feed direction, the cutout forming a needle drop hole on an edge of the cutout opposite from the open edge, a fabric guide member disposed a distance from the presser foot holder, fixed to the fabric presser member at one end and adjacent to the open edge, the fabric guide member forming a fabric guide portion having a vertical face disposed substantially along the fabric feed direction for guiding the fabric in the fabric feed direction, and a thread guide member having a thread guide portion fixed to the fabric guide member and arranged so as to extend across the cutout in the region of the open edge, the elastic fabric presser portion being located between the thread guide portion of the thread guide member and the needle drop hole of the fabric presser member, and being formed so as to press against the fabric being sewn.

10 Claims, 12 Drawing Figures

HEM STITCHING PRESSER FOOT FOR A ZIGZAG SEWING MACHINE

BACKGROUND OF THE INVENTION

The present invention relates to a hem stitching presser foot for a zigzag sewing machine which forms stitches using upper and lower thread, whereby stitches equivalent to hem stitches produced by over-lock or inter-lock sewing machines are satisfactorily produced.

It is widely known that fabric hems of sewn products are easily frayed thereby spoiling the outer appearance of the sewn product and yielding a shorter length of service of the sewn product. To avoid such disadvantages, many types of hem stitches including manual types are produced. The over-lock or interlock sewing machines can produce a number of hem stitches very rapidly, however, these sewing machines are expensive and are professionally used for only a single function. Notwithstanding the necessities thereof, it is uneconomical and difficult to furnish such sewing machines for ordinary home use. When not using such professional sewing machines zigzag stitching is normally performed as hem stitching along the fabric hem by means of a single needle. But since such hem stitching does not include the threads to cover the hem along the fabric edge, it is inferior in comparison with the stitching produced by the above-mentioned professional sewing machine. Therefore, hem stitches of high grade have not been realized in ordinary home sewing.

SUMMARY OF THE INVENTION

It is an object of the present invention to remove the defects of the prior art as mentioned above.

An object of the present invention is to produce stitches equivalent to hem stitches produced by over-lock or inter-lock sewing machines by devising an easy process for using a fabric pressor on a zigzag sewing machine.

Another object of the present invention is to produce stitches without defects by providing a fabric pressor which presses the fabric beneath the needle hole thereby preventing disorientation of the fabric during stitching.

DETAILED DESCRIPTION OF THE PREFERRED EMBODIMENTS

Figure 1:
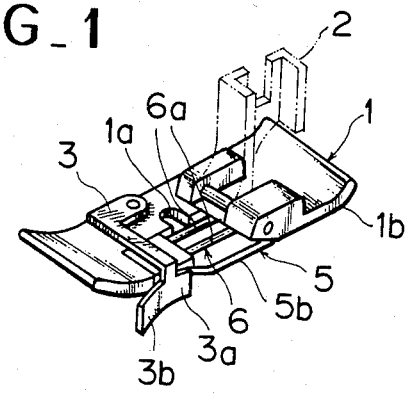
FIG. 1 is a perspective view of the device according to the present invention.
Figure 2:
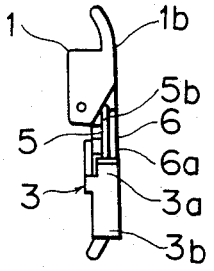
FIG. 2 is a side view of the present invention shown in FIG. 1.
Figure 3:
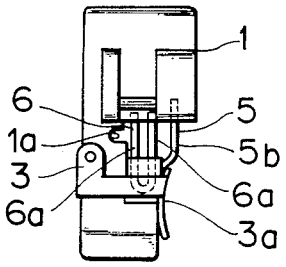
FIG. 3 is a plan view of the present invention shown in FIG. 1.

The present invention will be explained in accordance with the embodiments shown in the drawings. A fabric presser member 1 has a bottom 1*b* and is pivoted to a presser foot holder 2 which is fixed to a lower end of a presser bar attached to a machine head (both not shown). The presser 1 is centrally formed with a cut out comprising a needle drop hole 1*a*, and is secured with a fabric guide member 3, of an elastic member, over the needle drop hole 1*a* opposite to the pressor foot holder 2. The fabric guide member 3 is formed with a fabric guide portion 3*a* which is disposed along the fabric feed direction shown by the arrow in FIG. 1 and has a bottom 3*b* that projects below the bottom 1*b* of the presser 1. A thread guide member 5, made of a heat-treated steel wire, is fixed at its base to the fabric guide member 3 of the presser 1. A thread guide portion 5*b* is disposed along the feed direction outside of the fabric guide portion 3*a* and toward the presser foot holder 2. The thread guide portion 5*b* has a bottom which is slightly above the bottom 1*b* of the presser 1.

An elastic fabric presser member 6 is formed in a U-shape and has a basic portion that is held to the fabric guide member 3. The fabric presser member 6 is formed with two fabric pressers 6*a* extending parallel to one another in the fabric feed direction. The fabric pressers 6*a* elastically press the fabric between the thread guide portion 5*b* of the thread guide member 5 and the needle drop hole 1*a* of the presser 1.

Figure 4:
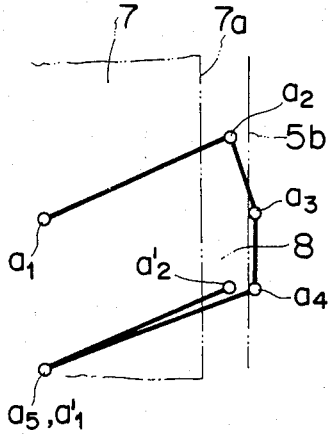
FIG. 4 is a pattern of hem stitches.
Figure 5:
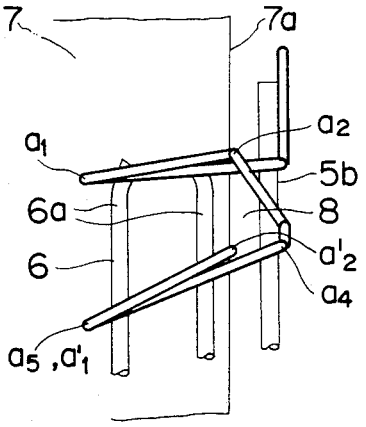
FIG. 5 shows stitches produced by the stitching pattern of FIG. 4.
Figure 6:
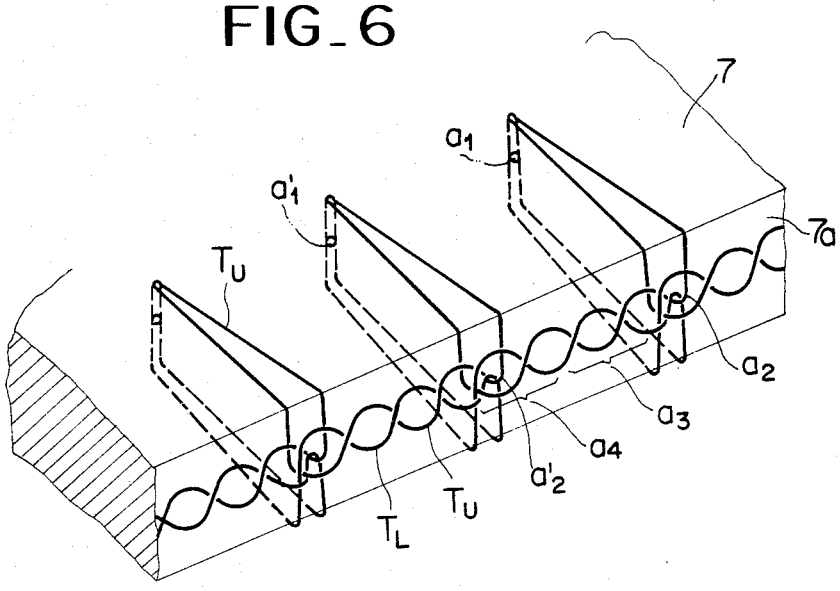
FIG. 6 is a perspective view of the stitches of FIG. 5.

An embodiment of the present invention is constructed as mentioned above, and its operation will next be described. FIG. 4 shows one example of the pattern formed by the present device. The pattern is stored electronically in a microcomputer (not shown) or mechanically by pattern cams (not shown). In FIG. 4, stitches a1, a5 are formed on fabric 7. The stitch a8 is formed at the hem 7*a* of the fabric 7, and the stitches a3, a4 are formed outside of the thread guide portion 5*b*. One cycle of hem stitching contains the stitches a1, a2, a3, a4, and a5. The stitches are formed as the fabric guide portion 3*a* of the guide member 3 lightly touches the hem 7*a* of the fabric 7. As shown in FIG. 5, the stitches a1, a5 are formed on the fabric 7, the stitch a2 is formed at the hem 7*a* of fabric 7, and stitches a3, a4 are formed along the right side of the thread guide portion 5*b* of the thread guide member 5. A stitch a'2 of a subsequent cycle, is formed in a thread loop 8 which is formed by the stitches a1, a2, a3, a4, and a5 of the previous cycle. Thus, the hem stitching at the hem 7*a* of the fabric 7 is produced as shown in FIG. 6 where it is shown that TU is an upper thread and TL is a lower thread. As seen from FIG. 6, since the upper thread TU and the lower thread TL are disposed in such a way as to cover the hem 7*a* of fabric 7, the hem stitching which is equivalent to hem stitching by the over-lock sewing machine may be obtained.

Since the fabric 7 is elastically pressed by the fabric presser 6*a* of the presser member 6, the fabric 7 is prevented from vertical displacement caused by friction with the needle, and undesirable stitches may be avoided.

Figure 7:
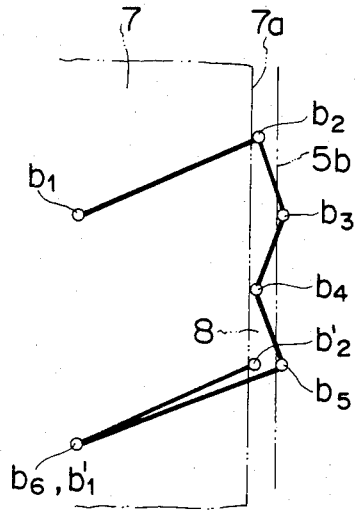
FIGS. 7, 8 and 9 are stitching patterns of hem stitches according another embodiment of the present invention.
Figure 9:
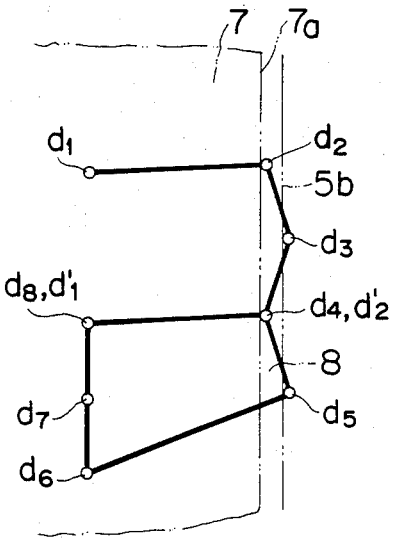
Figure 11:
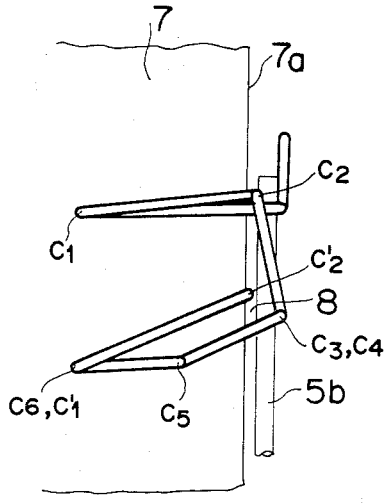
FIGS. 10, 11 and 12 are stitches produced by the stitching patterns of FIGS. 7, 8 and 9, respectively.
Figure 10:
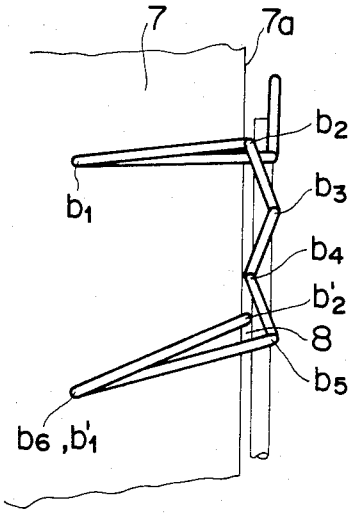

FIGS. 7 and 9 show another embodiment of patterns of hem stitches produced by the present invention. FIGS. 10 and 11 show stitches formed by these patterns.

In FIG. 7, the stitches b1, b6 are formed on the fabric 7, the stitches b2, b4 formed at the hem 7*a* of the fabric 7, and the stitches b3, b5 are formed outside of the thread guide portion 5*b*. The stitches b'1, b'2 are part of the stitches of a subsequent cycle.

FIG. 10 stitches formed by the pattern shown in FIG. 7, and a stitch b'2 formed in the thread loop 8.

Figure 8:
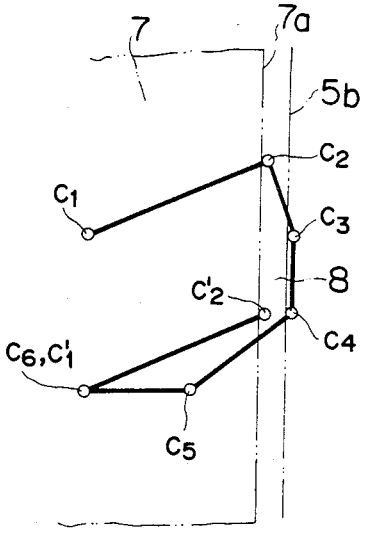

In FIG. 8, stitches c1, c5 and c6 are formed on the fabric 7, a stitch c2 is formed at the hem 7*a* of the fabric 7, and stitches c3 and c4 are formed outside of the thread guide portion 5*b*. Stitches c'1, c'2 are part of a subsequent stitching cycle. FIG. 11 shows the stitching produced by the pattern shown in FIG, 8, and a stitch c'2 formed in a thread loop 8.

In FIG. 9, stitches d1, d6 and d7 are formed on the fabric 7, stitches d2 and d4 are formed at the hem 7*a* of the fabric 7, and stitches d3 and d5 are formed outside of the thread guide portion 5*b*. Stitches d'1 and d'2 are part of a subsequent cycle.

Figure 12:
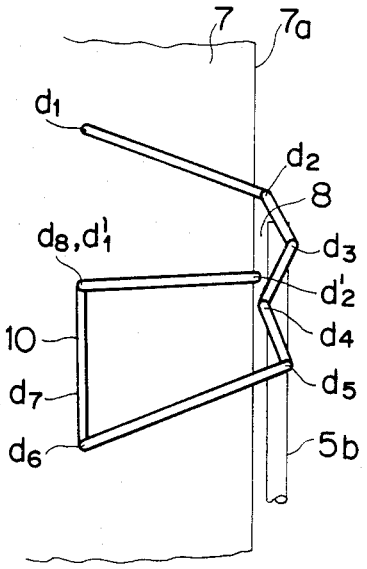

FIG. 12 shows the stitches produced by the pattern shown in FIG. 9, and since a sew-up 10 is formed on the fabric 7, the stitches are thereby equivalent to hem stitches produced by an inter-lock sewing machine. A stitch d'2 is also formed in the thread loop 8.

The embodiment of the present invention is constructed and operated as mentioned above. Stitches equivalent to hem stitches by an over-lock sewing machine or an interlock sewing machine may be produced by an easy process using the presser foot on a zigzag sewing machine which forms straight stitches from upper and lower threads. The elastic fabric pressing member 6 which presses the fabric in the area of needle penetration is provided so that undesirable stitches may be avoided.

We claim:

1. A hem stitching device, of a zigzag sewing machine, having a fabric feed direction, for forming a hem on a fabric, comprising: a presser holder; a fabric presser member pivotally mounted to said presser holder and having one end, a fabric presser portion and a needle drop hole; a fabric guide member disposed a distance from said presser holder; and a thread guide member having a thread guide portion fixed to said fabric guide member, said thread guide member being composed of a wire material, said fabric guide member being fixed to said fabric presser member at said one end, and said fabric presser portion located between and substantially opposite said needle drop hole and said thread guide member and being formed so as to press the fabric between said thread guide portion of said thread guide member and said needle drop hole of said fabric presser member.

2. A hem stitching device, of a sewing machine, having a fabric feed direction, for forming a hem on a fabric, comprising: a presser holder; a fabric presser member pivotally mounted to said presser holder and having one end, a bottom, a fabric presser portion and a needle drop hole; a fabric guide member disposed a distance from said presser holder and forming a fabric guide portion disposed substantially along the fabric feed direction, said fabric guide portion having a fabric guide bottom projecting below said bottom of said fabric presser member so as to guide the hem of the fabric, and a thread guide member having a thread guide portion fixed to said fabric guide member, said fabric guide member being fixed to said fabric presser member at said one end, and said fabric presser portion located between and substantially opposite said needle drop hole and said thread guide member and being formed so as to press the fabric between said thread guide portion of said thread guide member and said needle drop hole of said fabric presser member.

3. A hem stitching presser foot, for a zigzag sewing machine having a fabric feed direcion and a presser foot holder, for forming a hem on a fabric, said presser foot comprising: a fabric presser member pivotally mounted to said presser foot holder and having one end, an elastic fabric presser portion and a cutout having an open edge extending in the fabric feed direction, said cutout forming a needle drop hole on a edge of said cutout opposite from said open edge; a fabric guide member disposed a distance from the presser foot holder, fixed to said fabric presser member at said one end and adjacent to said open edge, said fabric guide member forming a fabric guide portion having a vertical face disposed substantially along the fabric feed direction for guiding the fabric in the fabric feed direction; and a thread guide member having a thread guide portion fixed to said fabric guide member and arranged so as to extend in the fabric feed direction across said cutout in the region of said open edge, said elastic fabric presser portion being located between and substantially opposite said thread guide portion of said thread guide member and said needle drop hole of said fabric presser member and being formed to press against the fabric being sewn in the area of the needle drop hole so as to prevent vertical displacement of the fabric.

4. The device as defined in claim 3, wherein said needle dropping hole is disposed between said fabric guide member and said presser holder.

5. The device as defined in claim 3, wherein said thread guide portion is disposed outside said fabric guide member and substantially along the fabric feed direction.

6. The device as defined in claim 3, wherein said fabric guide member is composed of an elastic material.

7. The device as defined in claim 3 wherein said fabric presser member is composed of an elastic material.

8. The hem stitching presser foot as defined in claim 3, wherein said fabric presser member has a bottom and said vertical face of said fabric guide portion has a bottom edge located in a plane slightly lower than said bottom of said fabric presser member, said fabric guide member further including an elastic arm connecting said fabric guide portion to said one end of said fabric presser member so that said fabric guide portion and said vertical face are vertically yieldable.

9. The hem stitching presser foot as defined in claim 3, wherein said cutout is defined by a first edge and a second edge extending laterally to the fabric feed direction and opposite to each other, and by a third edge substantially extending in the fabric feed direction and connecting said first edge and said second edge, and said elastic fabric presser portion is a U-shaped wire defining a pair of arms that extend parallel to one another across said cutout from said first edge to said second edge in the fabric feed direction.

10. The hem stitching presser foot as defined in claim 3, wherein said cutout is defined by a first edge and a second edge extending laterally to the fabric feed direction and opposite to each other, and by a third edge substantially extending in the fabric feed direction and connecting said first edge and said second edge, and said thread guide member is of a wire material that extends from said first edge to said second edge.

* * * * *